United States Patent [19]

El Gammal

[11] 4,208,207

[45] Jun. 17, 1980

[54] CARRIER BODY AND METHOD FOR INTRODUCTION OF A REACTION AGENT INTO METAL MELTS

[76] Inventor: Tareh El Gammal, Aachen, Fed. Rep. of Germany

[21] Appl. No.: 944,037

[22] Filed: Sep. 20, 1978

Related U.S. Application Data

[63] Continuation of Ser. No. 732,577, Oct. 15, 1976, abandoned.

[30] Foreign Application Priority Data

Oct. 15, 1976 [DE] Fed. Rep. of Germany ..... 2546103

[51] Int. Cl.[2] ..... C22C 33/08

[52] U.S. Cl. ..... 75/130 R; 75/53; 75/130 A

[58] Field of Search ..... 75/130 R, 130 A, 53

[56] References Cited

U.S. PATENT DOCUMENTS

| | | | |
|---|---|---|---|
| 3,681,051 | 8/1972 | Takashima | 75/53 |
| 3,953,198 | 4/1976 | Easwaran | 75/53 |
| 3,957,502 | 5/1976 | Cull | 75/130 R |

*Primary Examiner*—P. D. Rosenberg

*Attorney, Agent, or Firm*—Caesar, Rivise, Bernstein & Cohen, Ltd.

[57] ABSTRACT

A carrier body and method for introduction of a reaction agent into metal melts, the carrier body comprised of a fibrous substance, a reaction agent and a binder, the fibrous substance forming a reinforcing reticular structure within the carrier body and making the carrier body sufficiently porous to facilitate release of the reaction agent contained within the body, and the binder improving the cohesion of the carrier body. The treatment agent may be uniformly distributed throughout the carrier body or may be maintained at various places in the carrier body. Also, a granular refractory material is present as a filler in the carrier body. The method of introduction of the reaction agent into the hot melt involves introducing the carrier body into the hot melt in order to obtain essentially the complete release of the reaction agent into the hot metal melt.

48 Claims, 6 Drawing Figures

CARRIER BODY AND METHOD FOR INTRODUCTION OF A REACTION AGENT INTO METAL MELTS

This application is a continuation of Ser. No. 732,577, filed on Oct. 15, 1976 and now abandoned.

The invention concerns a carrier body for the introduction of a reaction agent embedded in a thermal insulating and gas permeable mass into metal melts.

Since the properties of metallic materials such as iron, cast iron and steel depend on their composition and especially on the presence and nature of certain impurities, it is usually necessary to add certain treatment agents such as alloying and/or refining agents to the metal melts concerned. For instance desulphurising agents are added to pig iron melts and deoxidation and alloying agents are added to steel melts. In addition it is often necessary to introduce certain aids such as oxide, carbides or fluxes, e.g. fluorides, into metal melts.

When introducing treatment agents, i.e. reaction agents and aids, there are special difficulties when the agents concerned are of a lighter specific weight than the melts to be treated and/or have a very high vapour pressure at the temperature of the molten metal. The high vapour pressure leads, namely when introducing the agents, in the light of the normally high bath temperatures of e.g. 1500° to 1600° C. for iron and steel melts, momentarily to an explosion-like vaporization of these treatment agents. The consequence of this is not only a generally higher loss of treatment agent, but in addition considerably danger to the personnel by metal and slag thrown out of the treatment vessel. In addition during explosive vaporization, the desired reactions between the melt and the reaction agent or aid do not take place because these reactions are dependent on time and require as uniform as possible a distribution of the reaction agent and aid in the melt.

A typical example of the difficulties when introducing a reaction agent with a low specific weight and high vapour pressure at the temperature of the melt is in the manufacture of iron with spheroidal graphite by means of magnesium. The vapour pressure of the pure magnesium is so high at the temperature of the molten iron that magnesium cannot be introduced into an iron melt under normal conditions at all. The introduction of magnesium therefore requires special devices such as pressure ladles and/or the use of a magnesium key alloy based on a carrier metal such as nickel, silicon and copper in order to reduce the vapour pressure of the magnesium and to dilute the magnesium equally with the carrier metal. Usually magnesium is present in amounts of about 4 to 17%, and sometimes up to 32%. Specific weights up to about 6 grams per cubic centimeter according to the proportion of the carrier metal are usual. Despite all these measures, the magnesium recovery does not normally exceed 40%. The introduction of the magnesium in the form of a key alloy does bring about on the one hand additional costs for the carrier metal, e.g. nickel in the case of a nickel/magnesium key alloy, and on the other hand the pressure of an undesirable, at least but not unconditionally necessary additional metal in the cast iron.

In addition, there are difficulties which result from the fact that the treatment agents generally have a lower specific weight than the metal melts to be treated so that the treatment agents concerned float on the surface of the bath and react with the slag there and/or the atmospheric oxygen. There are also considerable losses in this way, which impair the recovery.

There are similar disadvantages when the treatment agents are introduced in the form of briquettes or pressings into a metal melt, since the briquettes or pressings must have a considerable proportion of support material which has a heavier specific weight as regards as extensive as possible a reduction of the vapour pressure and an increase of the specific weight. The support material may be thermal insulating and gas permeable as in the case for coke impregnated with magnesium. Apart from its low specific weight the manufacture of magnesium-impregnated coke is difficult and dangerous, because the lumps of coke have to be immersed in molten magnesium. In addition, the capillary force is not sufficient to receive large quantities of magnesium.

The introduction of magnesium and other treatment agents with a low specific weight in the form of a key alloy or a briquette or pressing or impregnated coke into an iron melt is difficult and therefore requires special means. Therefore the key alloys or briquettes are partly inserted into a special pocket in the floor of a ladle and covered with steel waste before the melt to be treated is poured into the ladle. Another known process makes use of an expensive pressure ladle in which a pressure corresponding to the vapour pressure of magnesium is set, or a bell plunger by means of which the treatment agent is plunged deep into the melt. Furthermore, injection processes are known, in which the magnesium-containing addition is injected into the melt by means of a carrier gas and an injector. The carrier gas in this case is heated unnecessarily to the temperature of the melt and forcibly reduces the partial pressure of the magnesium and thereby also its activity. The above mentioned processes are very expensive and therefore make the manufacturing costs of SG cast iron considerably more expensive.

Similar difficulties as when making spheroidal graphite cast iron may also be produced during the desulphurization of metal melts with alkali metals and alkaline earth metals or rare earth metals during deoxidation and denitrogenization by means of aluminum and boron and also when introducing treatment agents in the form of chemical compounds such as borates as a flux or carbides.

The invention therefore has as its objective the production of a carrier body, with which treatment agents such as alkali metals, alkaline earth metals, rare earth metals and if applicable aids such as fluorides, carbides, borates, alumina, calcium oxide and silica can be introduced into metal melt, especially into iron and steel melts, giving a high recovery, i.e. with low losses, without the difficulties mentioned above. The solution of this task consists in the carrier body mentioned at the beginning, according to the invention, having a support or bedding mass based on an organic and/or refractory or inorganic fibrous material.

The use of a fibrous material as the main constituent of the support mass has the advantage that the constituents of the carrier body are dosed, mixed and in particular introduced in a preferred form, in the necessary amount, without difficulties. Another advantage consists in that the fibrous material gives the carrier body strength and porosity at the same time. The fibrous material surrounds the granular or powder treatment or reaction agent extensively and prevents in this way balling together or undesirable local differences in concentration. Consequently the treatment agents are in a homogeneous and if applicable finely dispersed distribution in the support mass, after thorough mixing, shaping and drying or curing of a binder. The result is that the melt can penetrate into the carrier body and dissolve the soluble constituents of the treatment agent, without the carrier body bursting.

Tests have shown that the carrier body is merely washed out by the melt and can be removed from the melt essentially undestroyed. This even applies if the support mass consists of paper, wood pulp, sawdust or textiles. Therefore particular importance is attached to it because these fibrous materials are available as waste products in large quantities and at extremely low prices.

In this way, the melt is not polluted as is the case when using key alloys, briquettes, pressings or even impregnated coke; instead, merely the washed out treatment agents remain in the melt. The recovery is high since the heating up, liquefaction and any vaporization or washing out of the treatment agents proceed slowly and progressively inwards from outside; i.e. the treatment agents are delayed in time and released in a dosed way. This entails the advantage that the treatment agents get into the melt and rise in the melt in droplets or bubbles. Consequently there is a large reaction surface of treatment agent/melt and long reaction times. In addition, sulphide or oxide inclusions which are difficult to separate, accummulate on the droplets and bubbles of the treatment agent, by which they are dragged along to the surface of the bath.

Finally, the heat losses when using the carrier body according to the invention are much lower than when introducing treatment agents by means of special devices, a carrier gas or a key alloy, because in the case of the carrier body according to the invention, only the thermal-insulating bedding mass is heated and merely the heat of solution is consumed for the treatment agent. In the case of the known processes, on the other hand, large quantities of heat are lost, because the introduction devices as well as the carrier metal and the carrier gas are heated compulsorily to the temperature of the melt and the heat of solution is used for the alloy carrier of a key alloy.

The support mass may also contain inorganic fibres, however, such as e.g. asbestos, glass wool and slag wood individually or side-by-side in order to give the carrier body a certain strength. In order to improve the cohesion of the carrier body, the initial mixture may also contain cold or hot set binders such as resin, synthetic resin or sodium silicate.

A quite considerable advantage of the carrier body according to the invention consists in the fact that due to its support mass consisting of fibrous material, it can be made into any shape without difficulty e.g. by extrusion or casting. In this for instance carrier bodies with a central opening can be made in order to plunge them into the melt to be treated, by means of a rod engaged into the central opening. The necessary opening may be made by bores too. In addition a carrier body with a support mass based on a fibrous material can also be ground to a certain measurement. However, due to its fibrous support mass, the carrier body can also be nailed on the bottom of a ladle or wound round a rod for introduction into a melt. On the other hand, extruded carrier bodies can also be sub-divided to certain lengths by sawing or cutting, without difficulty. Thereby, in the light of the homogeneous distribution of the treatment agent in the carrier body, easy dosing is possible.

The carrier body according to the invention can also have a thermal insulating covering layer in order to delay the beginning of the reactions between the treatment agent and the melt. On the other hand the carrier body can also have alternate layers with and without reaction agent. There are special advantages if the carrier body contains channel-forming substances because due to the channel system occurring during shrinkage or decomposition of the channel-forming substances, the melt can penetrate into the carrier body and/or the treatment agents can come out.

Although the fibres of the support mass surround the particles of the support mass more or less heavily according to the appropriate manufacturing conditions and thereby form cavities and channels, it can happen that the porosity produced by this is not sufficient for the penetration of the molten metal on the one hand and the emergence of the molten or vaporized gassing agent on the other.

This can be counteracted if the carrier body contains channel forming substances, e.g. substances which shrink in heat and decompose while reducing its volume, such as hanks or lengths of natural or sythetic fibres, threads, straw, pieces of fabric or wood chips. Under the influence of the temperature of the melt, directed or also undirected escape channels form in this way, whose total cross-section and distribution can be adjusted with regard to dosed release of the treatment agent, by the quantity of the channel-forming substances in the initial mixture. The channel-forming substances which are suitable are not only fibres connected together to fabrics or hanks but also if applicable perforated hoses and tubelets, e.g. made from plastics, metal or a refractory material.

Insofar as the carrier body must have a certain strength, it can contain strengthening inserts, e.g. also metal fabric or textile fabric. According to the nature this can be a permanent or also temporary, e.g. decomposing reinforcement insert.

Tests have proved that the carrier body can contain up to 50% magnesium without violent reactions or only bursting of the carrier body occurring in the melt, e.g. an iron melt. This is all the more surprising, as the conventional magnesium key alloys generally contain at most about 17% magnesium, in special cases at most about 30 to 32% magnesium. In the case of the carrier body according to the invention the magnesium content may also amount to 5–25% or up to 35%. The particle size of the magnesium may be very varied, but not exceeding preferably 0.5 mm in order to bring the particles into a finely dispersed distribution with as little as possible contact points between them. Contact points form bridges for heat transfer and impair the dosed release striven for and the reaction of the reaction agent.

The carrier body may also contain up to 10% paper, e.g. 2 to 6% paper and up to 6%, e.g. 2 to 4% organic binder. The remainder consists of a filler, e.g. a filler which is inert to the melt or an aid such as alumina, magnesium oxide, calcium oxide, silica, flurides, borates and carbides individually or side-by-side.

The invention is explained further below on the basis of the examples shown in the drawing. In the drawing the following figures show in diagrammatic sectional representation;

Figure 1:
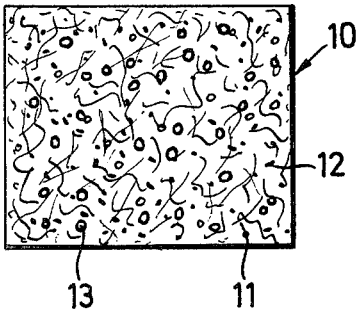
FIG. 1 shows a carrier body with finely dispersed distribution of a treatment agent.
Figure 2:
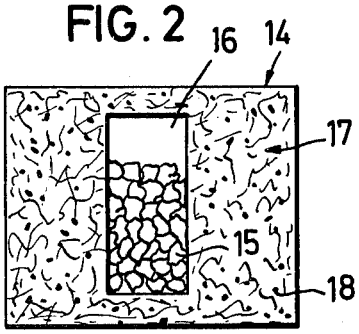
FIG. 2 shows a carrier body with a reaction agent in a cavity.
Figure 3:
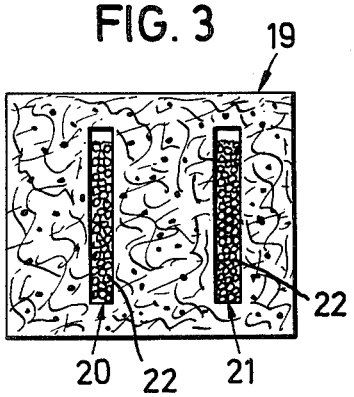
FIG. 3 shows an alternative (similar to FIG. 2) of a carrier body according to the invention.

The carrier body 10 shown in FIG. 1 consists of a fibrous material support or bedding mass 11, into which has been introduced a granular reaction agent 12 and also granular refractory material 13 as a filler in finely dispersed distribution and without mutual contact. The structure of the carrier body 14 of FIG. 2 is similar, but with the difference that the reaction agent 15 is in a cylindrical cavity 16, which is surrounded by a mass consisting of fibres 17, aids 18 and a binder. In order to prevent too strong a concentration of the reaction agent inside the carrier body, a carrier body 19 (FIG. 3) can also be provided with several cavities 20, 21, in which there is a reaction agent 22.

Figure 4:
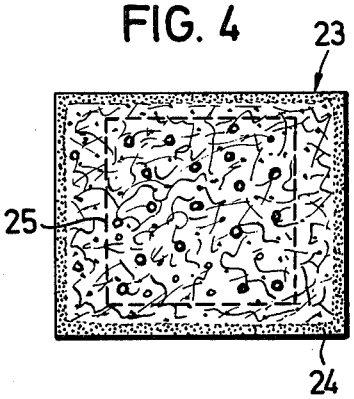
FIG. 4 shows a carrier body provided with a thermal insulating covering layer.

In addition, to reduce the heat transfer, a carrier body 23 (FIG. 4) can also be provided with a thermal insulating but gas permeable covering layer 24 and contain fabric-like strengthening inserts 25.

Figure 5:
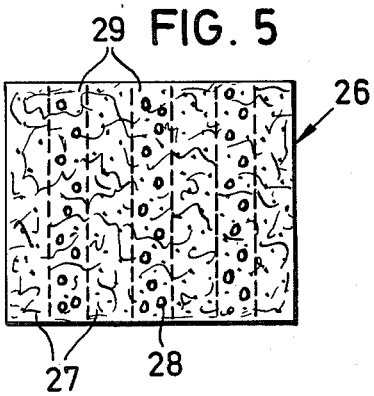
FIG. 5 shows a carrier body constructed layer-wise.

A carrier body 26 (FIG. 5) can also consist of alternating reaction agent-free layers 27 and layers 29 containing reaction agent 28.

Figure 6:
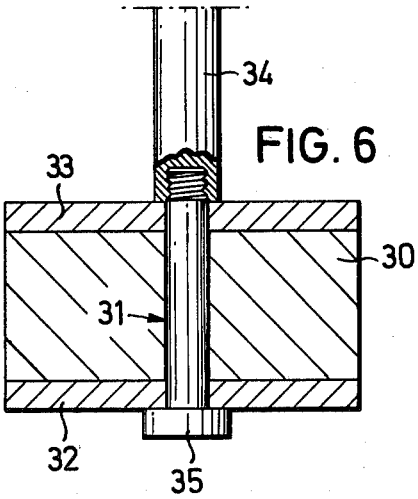
FIG. 6 shows a carrier body ready for introduction into a melt.

For the introduction into a melt a cylindrical carrier body 30 (FIG. 6) can have a central bore 31 and be fastened in between two perforated plates 32, 33. Through the holes of the plates 32 and 33 which are aligned with one another and with the central bore 31 runs a stepped plunge rod 34 between whose flange 35 and a nut 36 is braced the rod end of the carrier body 30 which rod end is provided at the front with a thread. This kind of plunge body does not incur much cost and is eminently suitable for plunging the carrier body into a melt. In addition the carrier body is not subject to much destruction, even if it must remain in the melt often for several minutes, for the complete release of the reaction agent.

Tests have proved that when making case iron with spheroidal graphite the dwell time of a carrier body necessary for a magnesium content in the cast iron of 0.02 to 0.08% (which has a magnesium content of 35%), in a bedding mass based on paper at a bath temperature of 1600° C. up to the complete release of the magnesium amounts to about 4 minutes. After this time the carrier body has essentially its original shape, which is a clear sign that with the exception of the magnesium as treatment agent, no other constituents of the carrier body are transferred into the melt.

The carrier body according to the invention therefore offers the guarantee that there is no pollution of the metal melt. This is important insofar as the carrier body according to the invention thereby presents the possibility to replace the deoxidation and desulphurization agents which lead to undesirable inclusions such as alumina, silicates, or sulphides, by the highly reactive alkali, earth alkali and rare earth metals.

Its low thermal capacity and its low volume mean extremely low heat losses. Finally, the treatment agent quantity can be adjusted exactly without difficulty by means of standard bodies of the kind shown in FIG. 7. This means only slipping on the necessary number of carrier bodies on to the front part of a plunge rod. On the other hand the carrier bodies can be sub-divided easily at any time in view of its support mass consisting of fibrous material, in order to allow accurate dosing of the treatment agent.

From the foregoing it can be seen that with the present invention there is provided a carrier body which can also be termed a carrier matrix to enable the safe use of a highly explosive reaction agent which is light in weight like magnesium. With the carrier matrix of the present invention the magnesium is provided in the form of finely sub-divided particles and the explosive nature of the magnesium is maintained by the presence of the filler. In use the carrier matrix is held at, or adjacent the bottom of the melt so that the magnesium particles can escape as the easily combustible fibrous material of the matrix is destroyed by the heat of the melt. Such destruction creates openings which allow the magnesium particles to escape with the heavier filler remaining behind. However, the filler still acts to prevent concentration of the magnesium particles and thereby avoid an explosive condition. Rather, the magnesium particles escape upwardly through the hot melt. As the magnesium escapes upwardly they remove from the hot melt unwanted sulphur to produce generally magnesium sulphide or wherein the sulphide or oxide, inclusions accumulate on the rising magnesium particles and are brought to the upper surface of the hot melt to form a slag.

The carrier matrix of this invention is made by providing an aqueous slurry which includes the fibrous substance or other destructable material, the reaction agent, the filer and the binder. The slurry is then dewatered and dried and in some cases heat will be applied either during or after the dewatering process, if the binder is a heat activatible binder. Normally, the manufacturing process will take place at room temperature, although somewhat elevated temperatures will be used where appropriate. After dewatering, drying and heating the carrier matrix is then sub-divided as required. In some cases the fibrous material may be replaced by non-fibrous substances. Also, non-combustible materials may sometimes be used.

Without further elaboration the foregoing will so fully illustrate my invention that others may, by applying current or future knowledge, readily adapt the same for use under various conditions of service.

What is claimed as the invention is:

1. A carrier matrix for introduction of a reaction agent into hot metal melts, said carrier matrix consisting essentially only of an inert fibrous substance, a reaction agent, a filler and a binder, the inert substance forming a reinforcing reticular structure within the carrier matrix and making the carrier body sufficiently porous to facilitate release of the reaction agent contained within said carrier body, said filler preventing undue concentration of said reaction agent, said binder improving the cohesion of said carrier body, whereby said reaction agent is released in said hot metal melt.

2. The carrier matrix of claim 1 wherein said reaction agent has a specific gravity less than said melt.

3. The carrier matrix of claim 2 wherein said reaction agent is present in the form of finely divided particles.

4. The carrier matrix of claim 3 wherein said reaction agent is explosive at the temperature of the hot melt.

5. The carrier matrix of claim 4 wherein the reaction agent is magnesium.

6. The carrier matrix of claim 4 wherein said filler serves to prevent the reaction agent from localizing to highly explosive concentrations.

7. The carrier matrix of claim 1 wherein said inert substance is selected from the group consisting of paper and sawdust.

8. The carrier matrix of claim 1 wherein said inert substance is selected from the group consisting of asbestos, glass wool and slag wool.

9. The carrier matrix of claim 1 wherein said reaction agent is selected from the group consisting of granular and powder alkali metals and rare earth metals.

10. The carrier matrix of claim 9 selected from the group consisting of alumina, magnesium oxide, calcium oxide, silica, fluorides, borates and carbides.

11. The carrier matrix of claim 1 wherein the reaction agent is in a cavity.

12. The carrier matrix of claim 1 including a thermal insulating covering layer.

13. The carrier matrix of claim 1 wherein alternating layers include said reaction agent.

14. The carrier matrix of claim 1 including channel-forming substances.

15. The carrier matrix of claim 14 wherein said channel-forming substances include fibres connected together.

16. The carrier matrix of claim 14 wherein the channel-forming substances are selected from the group consisting of tubelets and hoses.

17. The carrier matrix of claim 1 including strengthening inserts.

18. The carrier matrix of claim 1 wherein the reaction agent is magnesium which is present in an amount up to 50% by weight.

19. The carrier matrix of claim 18 wherein the magnesium is present from 5 to 25% by weight.

20. The carrier matrix of claim 1 wherein the particle size of magnesium does not exceed 0.5 mm.

21. The carrier matrix of claim 1 wherein the inert substance is paper and is present in an amount up to 10% by weight.

22. The carrier matrix of claim 21 wherein the paper is present in an amount from 2 to 6% by weight.

23. The carrier matrix of claim 1 wherein the binder is an organic binder present in an amount up to 6% by weight.

24. The carrier matrix of claim 23 wherein the organic binder is present in an amount from 2 to 4% by weight.

25. A method for introduction of a reaction agent into metal melts comprising introducing into the metal melt a carrier matrix consisting essentially only of an inert fibrous substance, a reaction agent, a filler and a binder, the fibrous substance forming a reinforcing reticular structure within the carrier body and making the carrier body sufficiently porous to facilitate release of the reaction agent contained within said carrier body, said filler preventing undue concentration of said reaction agent, said binder improving the cohesion of said carrier body, whereby said reaction agent is released in said hot metal melt.

26. The method of claim 25 wherein said reaction agent has a specific gravity less than said melt.

27. The method of claim 26 wherein said reaction agent is present in the form of finely divided particles.

28. The method of claim 27 wherein said reaction agent is explosive at the temperature of the hot melt.

29. The method of claim 28 wherein the reaction agent is magnesium.

30. The method of claim 28 wherein said filler serves to prevent the reaction agent from localizing to highly explosive concentrations.

31. The method of claim 25 wherein said inert substance is selected from the group consisting of paper and sawdust.

32. The method of claim 25 wherein said inert substance is selected from the group consisting of asbestos, glass wool and slag wool.

33. The method of claim 25 wherein said reaction agent is selected from the group consisting of granular and powder alkali metals and rare earth metals.

34. The method of claim 33 wherein said carrier matrix is selected from the group consisting of alumina, magnesium oxide, calcium oxide, silica, fluorides, borates and carbides.

35. The method of claim 25 wherein the reaction agent is in a cavity.

36. The method of claim 25 including a thermal insulating covering layer.

37. The method of claim 25 including alternating layers containing said reaction agent.

38. The method of claim 25 including channel-forming substances.

39. The method of claim 38 wherein said channel-forming substances include fibres connected together.

40. The method of claim 38 wherein the channel-forming substances are selected from the group consisting of tubelets and hoses.

41. The method of claim 25 including strengthening inserts.

42. The method of claim 25 wherein the reaction agent is magnesium which is present in an amount up to 50% by weight.

43. The method of claim 42 wherein the magnesium is present from 5 to 25% by weight.

44. The method of claim 42 wherein the particule size of magnesium does not exceed 0.5 mm.

45. The method of claim 25 wherein the inert substance is paper and is present in an amount up to 10% by weight.

46. The method of claim 45 wherein the paper is present in an amount from 2 to 6% by weight.

47. The method of claim 25 wherein the binder is an organic binder present in an amount up to 6% by weight.

48. The method of claim 47 wherein the organic binder is present in an amount from 2 to 4% by weight.

* * * * *